United States Patent [19]

Sheridan

[11] 4,080,200

[45] Mar. 21, 1978

[54] PROCESS FOR ALLOYING METALS

[75] Inventor: Philip F. Sheridan, Garden City, N.Y.

[73] Assignee: A. Johnson & Co. Inc., New York, N.Y.

[21] Appl. No.: 771,811

[22] Filed: Feb. 23, 1977

[51] Int. Cl.[2] ..... C22C 1/03

[52] U.S. Cl. ..... 75/135; 75/138; 75/148; 75/164

[58] Field of Search ..... 75/135, 138, 148, 164, 75/129

[56] References Cited

U.S. PATENT DOCUMENTS 3,592,637 7/1971 Brown et al. ..... 75/138

*Primary Examiner*—R. Dean

*Attorney, Agent, or Firm*—Hopgood, Calimafde, Kalil, Blaustein and Lieberman

[57] ABSTRACT

A process is provided for efficiently and rapidly alloying a slowly soluble solute metal with a molten host metal maintained at a temperature of T° C, the solute metal having a melting point of over T° C + 100° C. The alloying is effected without substantially superheating the molten host metal. This is achieved by forming a separate superheated hot melt of a master alloy of said solute metal with a portion of the host metal at a temperature in excess of T° C + 100° C and then blending said hot melt master alloy with said molten host metal to provide a predetermined final alloy composition of said host metal at an accelerated dissolution rate.

27 Claims, 2 Drawing Figures

PROCESS FOR ALLOYING METALS

Figure 1:
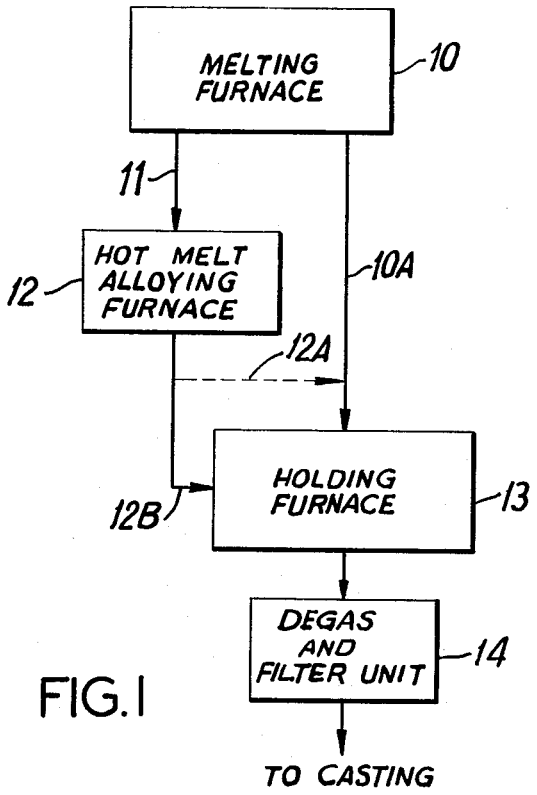

This invention relates to the addition of a slowly soluble solute metal to a molten host or solvent metal to produce an alloy thereof and, in particular, to a method for rapidly and efficiently alloying manganese with aluminum.

BACKGROUND OF THE INVENTION

The large scale alloying of a solute metal with a molten host or solvent metal is generally dependent on the dissolution rate of the solute metal therein. This particularly the case where the solute metal has a melting point substantially in excess of the melting point of the host metal.

For example, manganese-aluminum alloys, which are widely used commercially, present the problem of alloying because of the high melting point of manganese which is 1245° C compared to aluminum which has a melting point of about 660° C. The direct dissolution of manganese (e.g. electrolytic manganese in particulate form) in molten aluminum is difficult in that the rate of dissolution is very slow, particularly since the temperature of the aluminum melt is maintained at from about 705° to 760° C, e.g. 730° C to 745° C, in a holding furnace prior to the casting of the aluminum into the desired shape. Commercial manganese-aluminum alloys generally contain up to about 1.5% by weight of manganese, although manganese contents of about 2% to 3% are known for special purposes (see U.S. Pat. No. 3,930,895).

One conventional method for adding manganese to aluminum is to prepare a master alloy containing by weight 4% to 8% manganese and the balance aluminum so that the melting point of the master alloy is as close as possible to the temperature of the aluminum bath to be alloyed so as to effect rapid dissolution of the manganese master alloy, whether added in the solid or molten state to the aluminum bath which is maintained between about 705° C to 760° C. A disadvantage of this method is that a large amount of master alloy is required to produce only a small increase in the manganese content of the final alloy.

A second method is to use a master alloy containing by weight about 30% manganese which is added in the form of pieces, platelets or other particulate form to permit rapid dissolution of the master alloy in the aluminum bath. This alloy has a melting point of about 960° C which is much higher than the normal aluminum bath temperature of about 705° C to 760° C and, therefore, tends to dissolve slowly, even with agitation of the molten aluminum bath. Raising the temperature of the aluminum melt to accelerate the dissolution of the high manganese master alloy or even manganese itself is economically unfeasible since the temperature of the molten aluminum would have to be raised to well over 800° C or 900° C. Other prior art methods which have been proposed are as follows.

U.S. Pat. No. 3,592,637 discloses a method for the addition of a wide variety of alloying ingredients to molten aluminun comprising a blended mixture of 10% to 90% finely divided aluminum and 10% to 90% of the solute metals and alloys thereof, manganese being one of the metals. The addition of the blended mixture is said to accelerate the rate of dissolution of the solute metal.

In U.S. Pat. No. 3,788,839, finely divided metals are similarly used to effect alloying of metals. The method comprises using finely divided metals from the group Mn, Cr, Cu, Fe, Ni, Ti, V and Zr and alloys thereof containing at least 50% by weight of said metals and mixtures thereof. The finely divided metals (25% minus 80 mesh) are added to the molten bath in an amount by weight per unit area of the bath at least sufficient to penetrate the surface of the bath, the bath being stirred until the finely divided metal is completely incorporated therein.

Another method proposed comprised forming briquettes from a mixture of manganese and aluminum powder, the briquettes being then immersed in a bath of molten aluminum.

In U.S. Pat. No. 3,591,369, manganese is added to molten aluminum by providing the manganese with a coating of potassium chloride, such that, when the coated manganese is added to the bath, dissolution of the solid manganese metal is effected.

While the foregoing methods have been helpful in improving the dissolution rate of slowly soluble solute metals in molten metal baths, it would be desirable to provide an improved method for further accelerating the dissolution rate of slowly soluble solute metals. Examples of other solute metals are Fe, Ni, Co, Mn, Nb, Ta, V, Ti, Zr, Hf, W, Cr, Mo and Si.

OBJECTS OF THE INVENTION

It is thus the object of the invention to provide a method for accelerating the dissolution of slowly soluble solute metal in a molten host metal to produce an alloy of predetermined composition.

Another object of the invention is to provide a rapid method for the addition of a solute metal to a molten host metal.

Figure 2:
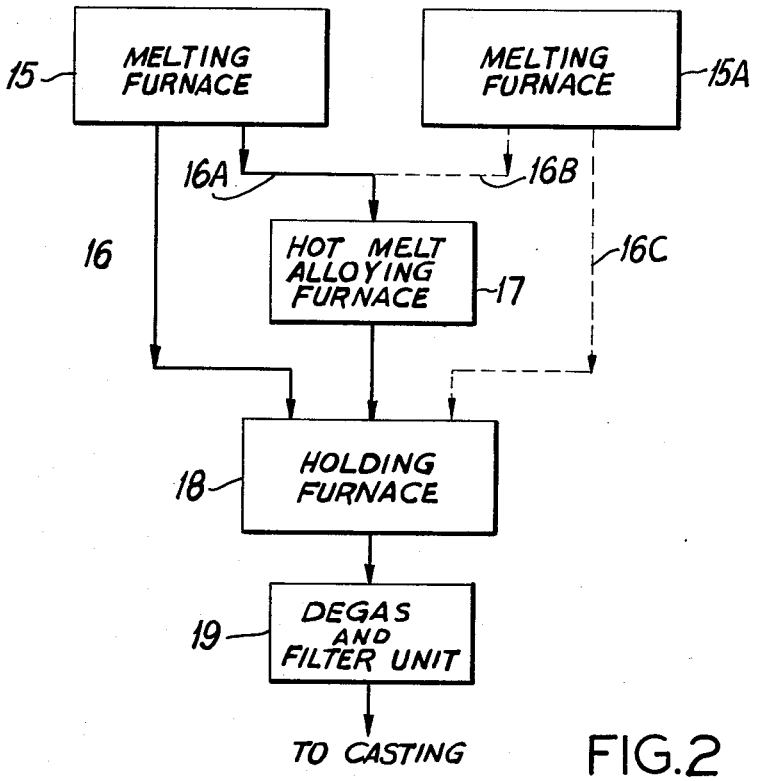

These and other objects will more clearly appear when taken in conjunction with the following disclosure and the accompanying drawings, wherein:

FIG. 1 is a flow sheet showing one embodiment for carrying out the invention; and FIG. 2 depicts a flow sheet of another embodiment for carrying out the invention.

BRIEF SUMMARY OF THE INVENTION

The invention is directed to a process for efficiently alloying slowly soluble solute metal with a molten host metal maintained at a temperature of T° C, said slowly soluble solute metal having a melting point over about T° C + 100° C. The term "slowly soluble solute metal" employed herein is meant to include one or more solute metals to be added to a molten host metal.

In carrying out the invention, a hot melt is formed with a portion of the host metal containing a predetermined amount of the solute metal to provide a molten master alloy in which the solute metal is substantially soluble, the master alloy formed being at a temperature in excess of T° C + 100° C, and generally in excess of about T° C + 200° C, the solute metal being sufficient to provide the amount desired for the final alloy composition. Not all of the solute metal need be dissolved in the molten master alloy. For example, the molten master alloy may be a liquidus-solidus mix so long as substantial or major amounts of the solute metal are dissolved, since the molten host metal to which the master alloy is added can complete the dissolution of the undissolved solute metal.

An advantage of the foregoing process is that only a small amount of the master alloy hot melt need be added to the molten host metal. Thus, the temperature increase of the host metal is moderate at best. In the case where the molten manganese-aluminum master alloy is an alloy containing 50% by weight of manganese, the melting point is about 1100° C. A 40% manganese alloy has a melting point about slightly over 1000° C; whereas, a 30% manganese alloy has a melting point of about 960° C. The master alloy may contain 5% to 60% by weight of solute metal and, preferably, 10% or 15% to 60% by weight of solute metal.

Stating it broadly, the solute metal to be alloyed with the host metal preferably includes those having melting points over about 1200° C, while the host metals include those having a melting point below 1100° C and generally below 960° C.

The solute metals included within the scope of the invention are selected from the group consisting of Fe, Ni, Co, Mn, Nb, Ta, V, Ti, Zr, Hf, W, Cr, Mo and Si.

Preferably, the invention is carried out by forming a molten bath of the host metal at a temperature of T° C, removing an aliquot portion of the molten host metal and charging it to a master alloying hot melt furnace, adding a predetermined amount of solute metal in particulate form to said hot melt furnace and raising the temperature thereof to over T° C + 100° C while stirring the hot melt to effect dissolution of substantially said solute metal and then mixing said hot melt aliquot portion with the remainder of said host metal, whereby rapid dissolution of said solute metal in said molten master alloy is effected in said host metal.

One embodiment of the invention is depicted schematically in the flow sheet of FIG. 1, using the manganese-aluminum system by way of illustration.

The aluminum is melted in melting furnace 10 and maintained at a selected temperature, such as about 735 ° C to 745° C (about 1350° F to 1375° F). An aliquot portion of molten aluminum 11 is transferred to hot melt alloying furnace 12 (e.g. an electric furnace) and pieces of electrolytic manganese charged to the hot melt furnace to provide a composition of about 50% by weight of manganese which is heated to 1150° C. The molten charge in the hot melt furnace is stirred to aid in the dissolution of the manganese, the stirring being conducted under inert conditions, e.g. an atmosphere of nitrogen. Vigorous stirring is preferred. Various methods for stirring molten metal, e.g. molten aluminum, are known and available to those skilled in the art. In the meantime, the remainder of the host metal is transferred from the melting furnace 10 to holding furnace 13 at said temperature of about 735° C to 745° C via transfer line 10A. The hot melt master alloy is blended with the remaining host metal in holding furnace 13 via either transfer line 12A fed into line 10A or by line 12B directly to the holding furnace as shown, wherein the desired final composition is obtained. Prior to casting the aluminum alloy, the alloy is degassed and filtered at 14 in the conventional manner. In removing the aliquot portion from the furnace, the portion is removed from below the surface of the melt to avoid feeding dross into the hot melt furnace. Where the hot melt is not produced under inert conditions, it may be necessary to filter out any dross that forms before adding the hot master alloy to the host metal.

With regard to the foregoing embodiment, the following example is given.

EXAMPLE 1

A melt of 100,000 lbs. of aluminum is produced as the host metal in the melting furnace at a temperature of about 745° C (about 1373° F). It is desired to produce a final manganese-aluminum alloy composition containing about 1.5% manganese by weight using a molten 50% manganese-aluminum alloy.

The amount of manganese necessary to provide a final composition of 1.5% in 100,000 lbs. of aluminum is calculated as follows:

$$1.5 = (x/100{,}000 + X) \times 100 \quad (1)$$

where $x$ = weight of manganese in pounds

By calculation X = 1522 lbs. manganese

Referring to the drawing, an aliquot portion of aluminum is removed from melting furnace 10 weighing about 1522 lbs. and charged into hot melt electric furnace 12, with 1522 lbs. of manganese also added to provide a 50% manganese master alloy, the remaining host metal amounting to about 98,478 lbs.

The master alloy is heated to about 1150° C (about 2100° F), the master alloy weighing about 3,044 lbs. The master alloy is blended together with the remaining host metal (745° C) at holding furnace 13 to produce, following completion of the mixing, a total weight of about 101,522 lbs. of final alloy assaying about 1.5% manganese as follows:

$$\% \text{ Mn} = (1522/101{,}522) \times 100 = 1.5\% \quad (2)$$

Assuming the master alloy melt and the host metal to have approximately the same specific heat, and assuming negligible heat losses, the temperature of the final blend just following mixing in the holding furnace is determined by the following heat balance equation:

$$M_1T_1 + M_HT_H = (M_1 + M_H)\, T_F \quad (3)$$

where $M_1$ is the weight of the master alloy (Mn—Al)

$M_H$ is the weight of the remaining host metal (Al)

$T_1$ is the temperature of the master alloy $T_H$ is the temperature of the host metal (Al)

$T_F$ is the final temperature of the blend

Thus, solving equation (3):

$$3044 \times 1150° \text{ C} + 98{,}478 \times 745° \text{ C} = (3044 + 98{,}478)\, T_F$$

$$T_F = 763° \text{ C}$$

As will be noted, the temperature of the aluminum bath increases from about 745° C (1373° F) to about 763° C (about 1405° F) which is a small increase considering that the molten master alloy had a temperature of about 1150° C (about 2100° F) before it was added to the host metal.

It is preferred that relatively high concentration of master alloys be employed since, the higher the concentration of the solute metal, the less is the amount of alloy needed to provide the desired final composition and hence the less the temperature of the host metal is raised. Thus, as stated hereinbefore, while the master alloy may contain about 5% to 60% by weight of solute metal, it is preferred that it contain 10% or 15% to 60% by weight of solute metal, such as 30%, 40% or even 50solute metal.

Sometimes, the host metal may contain small amounts of solute metal which must be increased to the desired level. The following example illustrates such a situation:

EXAMPLE 2

Molten aluminum containing 0.5% by weight manganese is increased in manganese content to about 1.5% as follows.

About 100,000 lbs. of the host metal at 0.5% Mn contains 500 lbs. Mn. The amount of make-up manganese to be added is calculated as follows:

| | | |
|---|---|---|
| Amount of original Mn | = | 500 lbs. |
| Amount of aluminum | = | 99,500 lbs. |
| | | 100,000 lbs. |

$X$ = weight of manganese to be added to raise the content to 1.5% by weight

Thus $$1.5 = \frac{500 + X}{99{,}5000 + 500 + X} \times 100 \quad (4)$$

or $1.5(100{,}000 + X) = (500 + X)100$ or $98.5X = 100{,}000$ $X = 1{,}015$ lbs.

$$\% \text{ Mn} = \frac{500 + 1{,}015}{100{,}000 + 1{,}015} \times 100 = \frac{1515}{101{,}015} \times 100 = 1.5\%$$

As illustrative of further embodiments of the invention, the following examples are given.

EXAMPLE 3

An aluminum alloy containing 2.5% manganese is produced as follows.

A 100,000 lb. melt of aluminum is prepared at a temperature of about 735° C (1350° F). About 2564 lbs. of manganese are required to produce an alloy composition of about 2.5% manganese. An aliquot portion of molten aluminum of about 10,255 lbs. is removed and charged into the hot melt furnace together with 2,564 lbs. of manganese to produce a hot melt weighing 12,819 lbs. containing 20% by weight of manganese.

EXAMPLE 4

Titanium has a high melting point of about 1800° C and is slowly soluble in copper. A 10,000 lb. charge of copper is melted and maintained at a temperature of about 1150° C. In order to produce a copper alloy containing about 0.5% titanium, an aliquot portion of molten copper of about 1,000 lbs. is taken and 50 lbs. of titanium added to it in a hot melt furnace and the composition heated to 1275° C to provide a master alloy containing approximately 5% titanium. The molten master alloy is then blended with the remaining molten copper to provide a final composition containing about 0.5% titanium. The final temperature of the blended alloy is approximately 1163° C.

EXAMPLE 5

Silicon is a well known additve to aluminum but has a rather high melting point of about 1420° C. For example, a cast alloy designated as Alloy No. 43 has 5% Si. The process of the invention is particularly applicable to production of this alloy.

Thus, 50,000 lbs. of molten aluminum is produced and maintained at a temperature of about 745° C. An aliquot portion of the aluminum is removed and charged into the hot melt furnace and sufficient silicon added to produce a master alloy containing 50% silicon, the amount of silicon being sufficient (about 2,640 lbs.) such that, when the hot melt alloy is blended with the host metal, the 5% silicon composition is produced. About 2,640 lbs. of molten aluminum is removed from the melting furnace and charged into the hot melt furnace together with 2,640 lbs. silicon and the mix heated to a temperature of about 1150° C to produce a molten master alloy containing 50% by weight of silicon. The molten master alloy is then blended with the remaining host metal of about 47,360 lbs. to produce the final 5% silicon alloy having a calculated weight of about 52,640 lbs. The temperature of the final molten alloy after mixing is approximately 785° C.

Since the purpose of the hot melt is to put the solute metal in the form easily soluble in the molten host metal, it is important that the aliquot portion of the host metal employed to produce the hot melt master alloy be not so large that when blended back with the remaining host metal, the host metal is not heated to too high a temperature.

Thus, the qliquot portion of the host metal employed in producing the master alloy preferably ranges from about 0.5% to 30% by weight, the master alloy containing about 5% to 60% by weight of the solute metal (or 10% to 60%). While a 5% master alloy is low, small amounts of this alloy may be used to produce a final alloy composition containing 0.25% by weight of the solute metal. As is clearly apparent, a master alloy with 60% solute metal would be used in relatively small amounts to produce a final desired composition in the host metal.

In producing a hot metal master alloy, the particulate solute metal employed as the additive may comprise a broad range of sizes. For example, in the case of manganese, large flakes of electrolytic manganese may be employed having a length of up to about 2 inches. Generally speaking, the smaller the size, the faster will be the dissolution rate in the hot melt furnace. Thus, a particle size of minus 10 mesh (U.S. Standard) may be employed.

| Wt.* of Host Metal (Al) | Temp. of Host Metal | Wt. of Hot Metal | Hot Melt Temp. | Temp. of Alloy** |
|---|---|---|---|---|
| 100,000 | 750° C | 1000 | 870° C | 751° C |
| 100,000 | 750° C | 1000 | 980° C | 753° C |
| 100,000 | 750° C | 1000 | 1095° C | 754° C |
| 100,000 | 750° C | 4000 | 870° C | 755° C |
| 100,000 | 750° C | 4000 | 980° C | 759° C |
| 100,000 | 750° C | 4000 | 1095° C | 764° C |
| 100,000 | 750° C | 8000 | 870° C | 757° C |
| 100,000 | 750° C | 8000 | 980° C | 765° C |
| 100,000 | 750° C | 8000 | 1095° C | 755° C |
| 100,000 | 750° C | 10,000 | 870° C | 764° C |
| 100,000 | 750° C | 10,000 | 980° C | 755° C |
| 100,000 | 750° C | 10,000 | 1095° C | 785° C |
| 100,000 | 750° C | 20,000 | 870° C | 775° C |
| 100,000 | 750°0 C | 20,000 | 980° C | 798° C |
| 100,000 | 750° C | 20,000 | 1095° C | 820° C |
| 100,000 | 750° C | 30,000 | 870° C | 788° C |
| 100,000 | 750° C | 30,000 | 980° C | 821° C |

*Total weight of host metal before removing aliquot portion
Final temperature of alloy produced after adding the hot melt master alloy In actual practice in which alloys of aluminum or other metals are continually produced, a standby melting furnace may be employed in conjunction with another melting furnace so that, while one melting furnace is being used to produce an alloy composition as depicted in FIG. 1**, the standby furnace is being prepared to produce a new heat.

Thus, referring to FIG. 2, a melting furnace 15 and a standby furnace 15A are shown, the heavy lines 16 and 16A extending from furnace 15 indicating that the furnace is being used to produce an alloy, line 16A feeding an aliquot portion of the melt into hot melt furnace 17, the master alloy formed then going into holding furnace 18 for blending with the molten host metal charged into the holding furnace via line 16. As shown, a degas and filter unit 19 is provided for cleaning the alloy of gases and dross before being sent to the casting station. The molten host metal may also be cleaned of gases in the holding furnace.

Following completion of the alloying of the metal from furnace 15, standby furnace 15A is then brought on stream as shown by dotted lines 16B and 16C to produce substantially the same alloy.

As will be appreciated by those skilled in the art, the invention is not limited to the addition of one solute metal, but rather is applicable to the addition of more than one solute metal to the host metal. Thus, the hot melt employed for adding manganese to molten aluminum may also contain such high melting metals as iron, silicon, etc., where the final aluminum alloy is to contain predetermined amounts of Mn, Fe and Si. The hot master alloy may thus contain at least one solute metal selected from the group consisting of Fe, Ni, Co, Mn, Nb, Ta, V, Ti, Zr, Hf, W, Cr, Mo and Si.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A process for efficiently alloying a slowly soluble solute metal in particulate form with a molten host metal maintained at a molten temperature of T° C, said solute metal having a melting point of over T° C+100° C and being substantially soluble in the said molten host metal which comprises, establishing a molten bath of said host metal at said temperature of T° C, establishing a molten master alloy bath of said solute metal with an aliquot portion of said host metal in a hot melt furnace at a hot melt temperature of over T° C+100° C, the amount of solute metal in said molten master alloy being sufficient when blended with the molten host metal to provide a final composition containing a predetermined percentage of said solute metal, and then mixing said hot melt master alloy with said molten host metal, whereby a final host metal composition is obtained at improved heat efficiency and improved rate of solubility of said solute metal in said molten host metal.

2. The process of claim 1, wherein the hot melt master alloy produced comprises a liquidus-solidus hot melt, with a portion of said particulate solute metal remaining undissolved prior to mixing said hot melt with said molten host metal for complete dissolution therein by stirring.

3. The process of claim 1, wherein the hot melt master alloy produced from said host metal portion and said solute metal is heated for a time sufficient to effect substantially complete solution of said solute metal in said hot melt prior to mixing said hot melt with said molten host metal.

4. The process of claim 1, wherein the solute metal is selected from metals having a melting point of over 1200° C and wherein the host metal has a melting point below 1100° C.

5. The process of claim 4, wherein the host metal has a melting point below 960° C.

6. The process of claim 4, wherein the solute metal is at least one metal selected from the group consisting of Fe, Ni, Co, Mn, Nb, Ta, V, Ti, Zr, Hf, W, Cr, Mo and Si.

7. The process of claim 4, wherein the solute metal is manganese and wherein the host metal is aluminum.

8. The process of claim 4, wherein the starting host metal contains an amount of said solute metal less than that desired in the final composition, and wherein the amount of said solute metal in said hot metal is sufficient when said hot melt is mixed with said host metal to raise the solute metal in said host metal to said desired final composition.

9. A process for efficiently alloying a slowly soluble solute metal with a molten host metal maintained at a molten temperature of T° C, said solute metal having a melting point of over T° C+100° C and being substantially soluble in said molten host metal which comprises, establishing a molten bath of said host metal at said temperature of T° C, adding an aliquot portion of said molten host metal to a hot melt furnace for forming a master alloy composition therein of said aliquot portion with said solute metal, adding a predetermined amount of said solute metal in particulate form to said hot melt furnace with the aliquot portion of said molten host metal heated to a hot melt temperature of over T° C+100° C while stirring said hot melt under substantially inert conditions to effect substantial dissolution of said solute metal in said hot melt, the amount of solute metal added being sufficient to provide a final host metal composition containing a predetermined percentage of said solute metal when said hot melt master alloy is subsequently added to said molten host metal, and then mixing said hot melt master alloy with the remainder of said host metal, whereby a final host metal-solute metal composition is obtained at improved heat efficiency and improved rate of solublity of said solute metal in said molten host metal.

10. The process of claim 9, wherein the hot melt produced from said aliquot host metal portion of said particulate solute metal comprises a liquidus-solidus hot melt, with a portion of said particulate solute metal remaining undissolved prior to mixing said hot melt with the remainder of said molten host metal for complete dissolution therein by stirring.

11. The process of claim 9, wherein the hot melt produced from said aliquot host metal portion and said particulate solute metal is heated for a time sufficient to effect substantially complete dissolution of said solute metal in said hot melt prior to mixing said hot melt with said molten host metal.

12. The process of claim 9, wherein the solute metal is selected from metals having a melting point of over 1200° C and wherein the host metal has a melting point below 1100° C.

13. The process of claim 12, wherein the host metal has a melting point below 960° C.

14. The process of claim 12, wherein the solute metal is at least one metal selected from the group consisting of Fe, Ni, Co, Mn, Nb, Ta, V, Ti, Zr, Hf, W, Cr, Mo and Si.

15. The process of claim 12, wherein the solute metal is manganese and wherein the host metal is aluminum.

16. The process of claim 12, wherein the starting host metal contains an amount of said solute metal less than that desired in the final composition, and wherein the amount of said solute metal in said hot melt is sufficient when said hot melt is sufficient when said hot melt is mixed with said host metal to raise the solute metal in said host metal to said desired final composition.

17. A process for efficiently alloying a slowly soluble solute metal with molten aluminum maintained at a temperature T° C at which said solute metal is slowly soluble which comprises, establishing a molten bath of said aluminum at said T° C, adding an aliquot portion of said molten aluminum to a hot melt furnace for forming a master alloy composition therein of said aliquot portion with at least one solute metal selected from the group consisting of Fe, Ni, Co, Mn, Nb, Ta, V, Ti, Zr, Hf, W, Cr, Mo and Si, adding a predetermined amount of said solute metal in particulate form to said hot melt furnace, with the aliquot portion of said molten aluminum heated to a temperature of over T° C while stirring said hot melt under substantially inert conditions to effect substantial dissolution of said solute metal in said hot melt, the amount of solute metal added being sufficient to provide a final aluminum composition containing a predetermined percentage of said solute metal when said hot melt master alloy is subsequently added to said molten aluminum, and then mixing said hot melt master alloy with the remainder of said molten aluminum, whereby a final aluminum-solute metal composition is obtained at improved heat efficiency and improved rate of solubility of said solute metal in said molten aluminum.

18. The process of claim 17, wherein the hot melt produced from said aliquot portion of said molten aluminum and said particulate solute metal comprises a liquidus-solidus hot melt, with a portion of said particulate solute metal remaining undissolved prior to mixing said hot melt with the remainder of said molten aluminum for complete dissolution therein by stirring.

19. The process of claim 17, wherein the hot melt produced from said aliquot aluminum portion and said particulate solute metal is heated for a time sufficient to effect substantially complete solution of said solute metal in said hot melt prior to mixing said hot melt with said molten aluminum.

20. The process of claim 17, wherein said solute metal is at least manganese.

21. The process of claim 20, wherein the starting aluminum contains an amount of manganese less than that desired in the final composition, and wherein the amount of manganese in said hot melt is sufficient when the hot melt is mixed with said aluminum to raise the manganese content in said aluminum to said desired final composition.

22. A process for efficiently alloying manganese with molten aluminum maintained at a temperature T° C at which said manganese is slowly soluble which comprises, establishing a molten bath of said aluminum at said T° C, adding an aliquot portion of said molten aluminum to a hot melt furnace for forming a master alloy composition therein of said aliquot portion with said manganese, adding a predetermined amount of said manganese in particulate form to said hot melt furnace, with the aliquot portion of said molten aluminum heated to a temperature of over T° C+100° C while stirring said hot melt under substantially inert conditions to effect substantial dissolution of said manganese in said hot melt, the amount of manganese added being sufficient to provide a final aluminum composition containing a predetermined percentage of said manganese when said hot melt master alloy is subsequently added to said molten aluminum, and then mixing said hot melt master alloy with the remainder of said molten aluminum, whereby a final aluminum composition is obtained at improved heat efficiency and improved rate of solubility of said solute metal in said molten aluminum.

23. The process of claim 22, wherein the hot melt produced from said aliquot portion of said molten aluminum and said particulate manganese comprises a liquidus-solidus hot melt, with a portion of said particulate manganese remaining undissolved prior to mixing said hot melt with the remainder of said molten aluminum for complete dissolution therein by stirring.

24. The process of claim 22, wherein the hot melt produced from said aliquot aluminum portion and said particulate manganese is heated for a time sufficient to effect substantially complete solution of said manganese in said hot melt prior to mixing said hot melt with said molten aluminum.

25. The process of claim 24, wherein the starting aluminum contains an amount of manganese less than that desired in the final composition, and wherein the amount of manganese in said hot melt is sufficient when the hot melt is mixed with said aluminum to raise the manganese content in said aluminum to said desired final composition.

26. The process of claim 22, wherein said hot melt master alloy produced contains from about 5% to 60% manganese.

27. The process of claim 22, wherein the aliquot portion of aluminum employed ranges from about 0.5% to 30% by weight of the established aluminum bath.

* * * * *